US005255532A

United States Patent [19]

Chae et al.

[11] Patent Number: 5,255,532

[45] Date of Patent: Oct. 26, 1993

[54] AIR CONDITIONER

[75] Inventors: Yong B. Chae, Seoul; Jong E. Park, Suweon-City, both of Rep. of Korea

[73] Assignee: Samsung Electronics Co., Ltd., Suwon City, Rep. of Korea

[21] Appl. No.: 951,754

[22] Filed: Sep. 28, 1992

[30] Foreign Application Priority Data

Sep. 27, 1991 [KR] Rep. of Korea ..... 91-16831
Oct. 24, 1991 [KR] Rep. of Korea ..... 91-17826[U]

[51] Int. Cl.[5] ..... F25B 29/00
[52] U.S. Cl. ..... 62/325
[58] Field of Search ..... 62/325

[56] References Cited

U.S. PATENT DOCUMENTS 3,084,522 4/1963 Hames, Jr. et al. ..... 62/325 X
4,297,855 11/1981 McCarty et al. ..... 62/325
4,359,876 11/1982 McCarty ..... 62/325 X

FOREIGN PATENT DOCUMENTS 61-39233 11/1986 Japan .

*Primary Examiner*—William E. Tapolcai
*Attorney, Agent, or Firm*—Burns, Doane, Swecker & Mathis

[57] ABSTRACT

An air conditioner comprises upper and lower sections. Each section includes a heat exchanger, a fan, and a wall which is slidably between opposite sides of the air conditioner. The heat exchangers are pivotable relative to their respective fans. By sliding the wall and pivoting the heat exchanger of either section, that section can be placed in communication with either the inside ambient air of the ambient outside air for performing a heating or cooling function. The air conditioner can thus be reversed between heating and cooling functions without reversing the direction of refrigerant cooling.

16 Claims, 8 Drawing Sheets

AIR CONDITIONER

FIELD OF THE INVENTION

The present invention is related to an air conditioner, and more particularly to an air conditioner which selectively cools and heats without reversing the flow of refrigerant.

BACKGROUND OF THE INVENTION

FIG. 1 illustrates a conventional air conditioner with an evaporator 10, a condenser 30 facing one face of the evaporator, an integral stationary casing 1 disposed longitudinally between the evaporator and the condenser, and cross fans 40, 41 for guiding air toward the evaporator 10 and the condenser 30 respectively. At the respective upper and lower ends of the casing 1, the respective upper and lower frames 2, 3 are located. Under the lower frame 3 are disposed fan motors (not shown) which are connected to the cross fans, respectively. Further, under the lower frame 3 is disposed a compressor 5 for compressing and discharging a refrigerant. On the upper frame 2 are engaged supporting members 42, 43 which support the upper shafts of the cross fans, respectively. Cooling air is discharged through a grill 6. A filter 7 removes dust from an air flow.

However, a problem occurs because the evaporator and the condenser are juxtaposed along their faces, causing the width of the air conditioner to become too massive. In the installment of the air conditioner in a wall, a significant protruding portion of the air conditioner from the wall requires extra support means, such as brackets and the like, which detracts from the appearance of the air conditioner. Further, two fan motors are required for rotating a pair of cross fans.

In order to resolve the problem, an air conditioner has been developed and disclosed in Japanese Utility Model Publication No. 1986 - 39233. The air conditioner comprises a first casing located in the place where the indoor air enters though the front portion and discharges through the same portion, and a second casing located therebelow in the place where the outdoor air enters though the rear portion and discharges through the same portion. The heat exchangers intersect as viewed in plan, and the cross fans are coaxially disposed. Between the upper cross fan and the lower cross fan is placed a transmission for rotating reversibly the cross fans. A fan motor is placed at one end of the fans and opposite the transmission. This arrangement reduces the size of the air conditioner.

However, the air conditioner requires an additional changeover device for reversing the flow of the refrigerant in order to selectively heat or cool the air flowing through it. Furthermore, the condensate generated by the evaporator drops down onto an intermediate platform without any further use to the air conditioner which decreases the efficiency of the air conditioner.

SUMMARY OF THE INVENTION

The present invention seeks to provide an air conditioner which easily and effectively solves the above mentioned problems.

The object of the present invention is to provide an air conditioner in which both the cooling and heating functions are achieved in one system without reversing the flow of the refrigerant in the system.

Another object of the present invention is to provide an air conditioner in which the condensate formed in the evaporator drops down to the condenser so as to increase heat loss therefrom.

According to the present invention, an air conditioner system comprises an evaporator and a condenser which are pivotally disposed respectively in a reverse manner within a predetermined range by a swing member which is coupled to an end of the evaporator and that of the condenser in a same direction. Further, an air conditioner comprises screen members arranged so as to travel back and forth between the front face of the evaporator and that of the condenser and the rear face of the evaporator and that of the condenser. The upper screen for the evaporator and the lower screen for the condenser travel in a reverse manner by a traveling member which is connected to both ends of the screens. Furthermore, in a frame are formed intermediate platform members over which is disposed the evaporator and under which is disposed the condenser. The intermediate platform members comprises an upper platform having a condensate drain passage and a lower platform having a plurality of openings formed along an upper portion of the condenser.

When in a cooling condition, the upper screen member in placed adjacent to the rear face of the evaporator, and the lower screen member is placed adjacent to the front face of the condenser. Then in a heating condition, the positions of the evaporator and condenser are switched, and the screen members are positioned on opposite sides of the air conditioner. That is, the upper screen member is placed adjacent to the front face of the evaporator, and the lower screen member is placed adjacent to the rear face of the condenser. During the cooling operation, a condensate generated from the evaporator drops down to the intermediate platform and the water gathered toward the drain passage falls onto the upper portion of the condenser through the openings.

DETAILED DESCRIPTION OF THE PREFERRED EMBODIMENT

Figure 1:
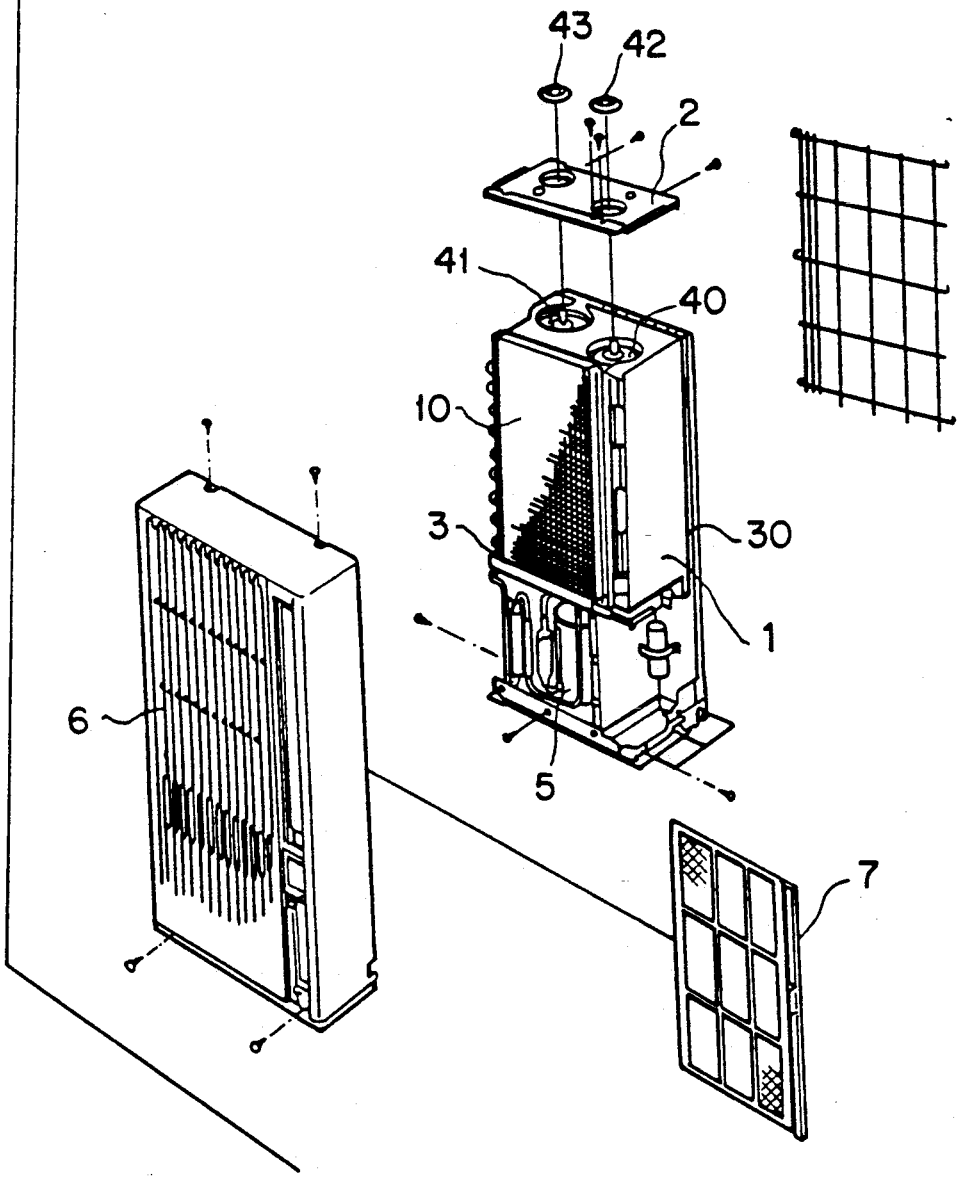
FIG. 1 (PRIOR ART)
FIG. 1 is an exploded perspective view of an air conditioner according to the prior art.
Figure 2:
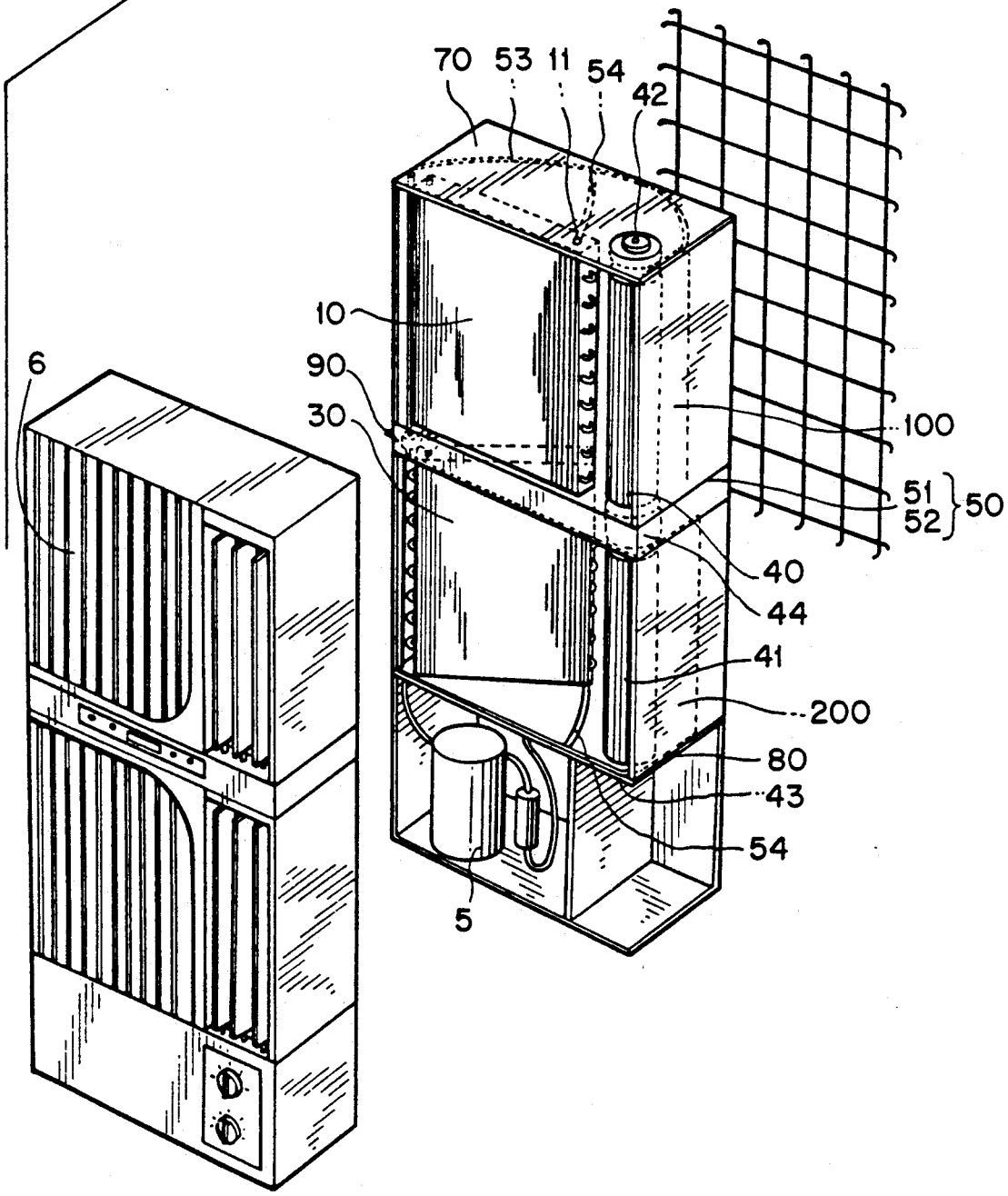
FIG. 2 is an exploded perspective view of an air conditioner according to the present invention.
Figure 6:
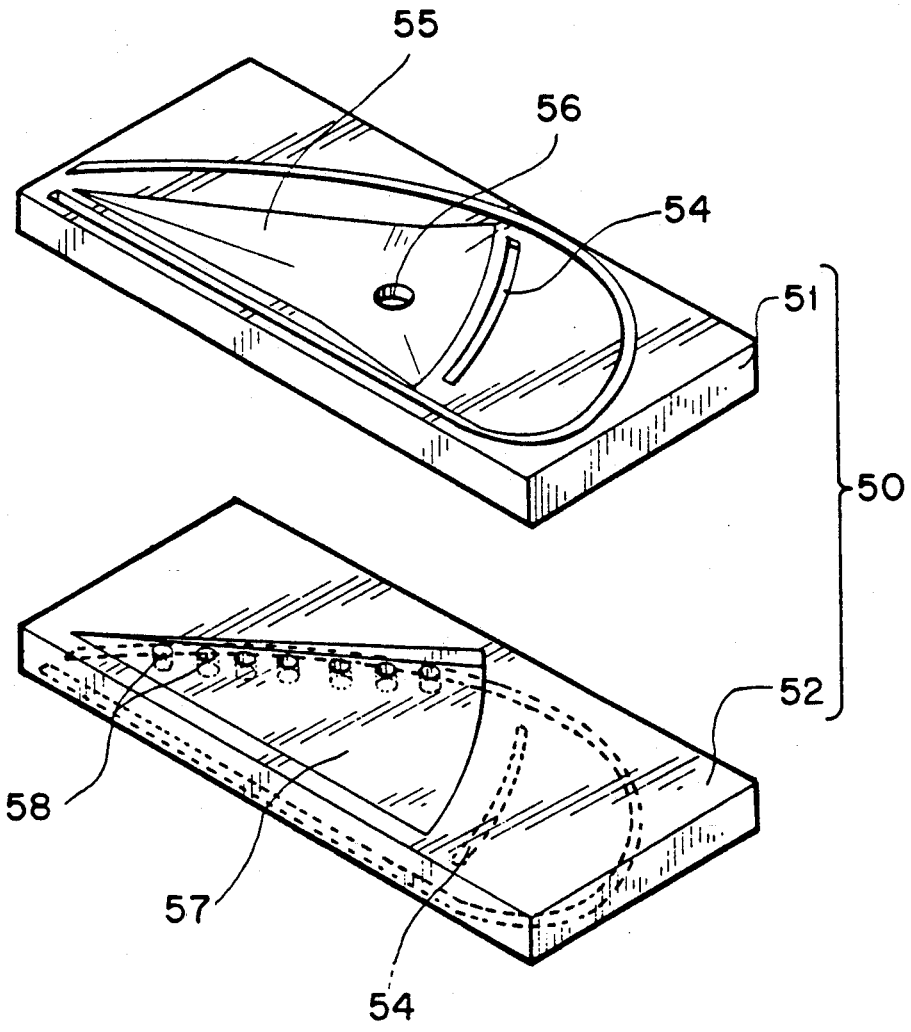
FIG. 6 is an exploded perspective view of an intermediate platform member according to the present invention.

FIGS. 2 and 6 illustrate the air conditioner in accordance with the preferred embodiment of the present invention.

Figure 3:
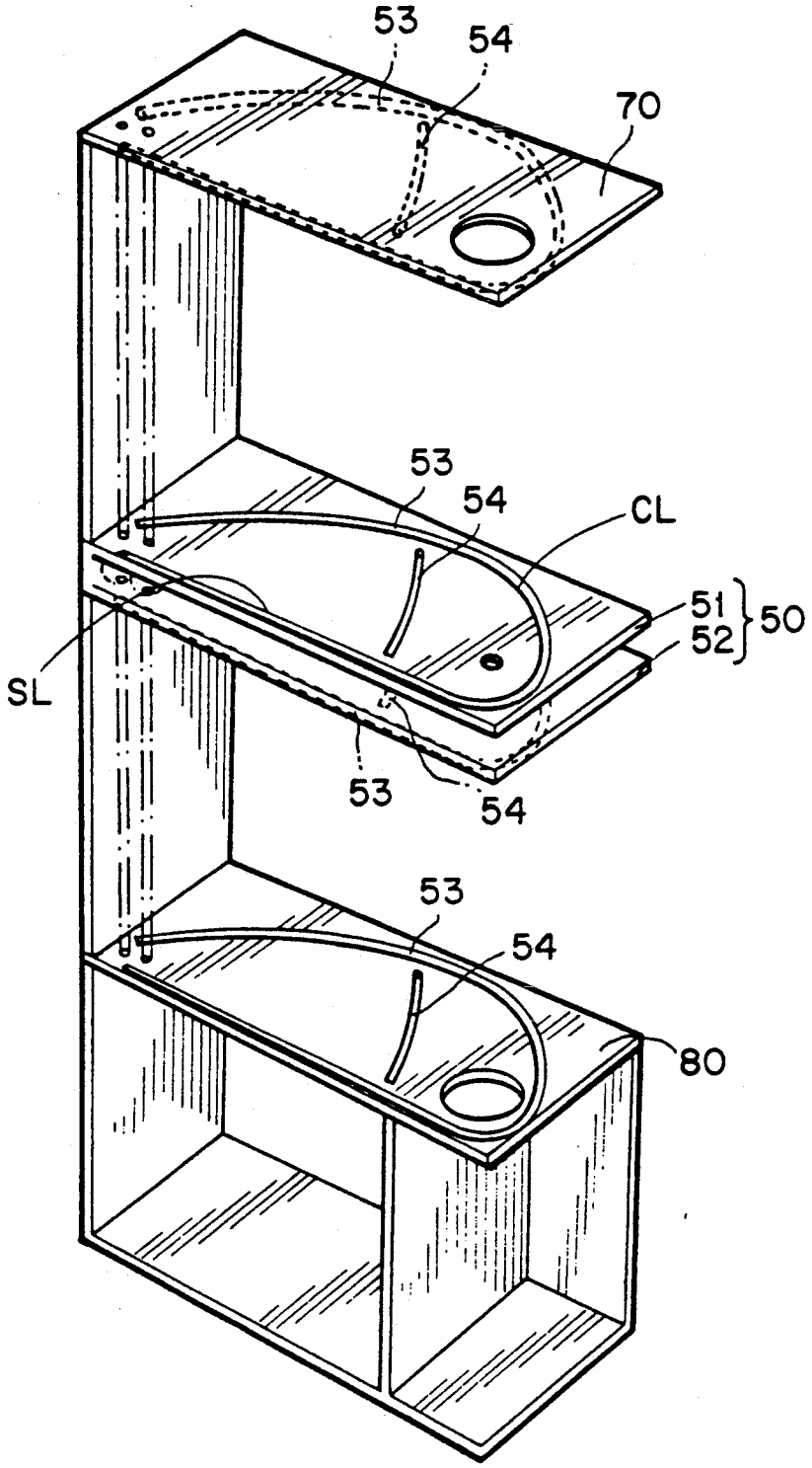
FIG. 3 is a perspective view of a frame used in the air conditioner depicted in FIG. 2.

The air conditioner includes an evaporator 10 and a condenser 30 which are pivotally mounted on a control means 90, with the evaporator 10 arranged over the condenser 30. Between the evaporator 10 and the condenser 30 is disposed an intermediate platform member 50 which comprises a lower intermediate platform 52 and a upper intermediate platform 51. An upper platform 70 is disposed over the evaporator 10, and a lower platform 80 is disposed beneath the condenser 30. A wall arrangement is provided which comprises an upper wall 100 for the evaporator 10 and a lower wall 200 for the condenser 30. The wall 100 is arranged so as to travel back and forth between the front and rear faces of the evaporator 10 (see FIGS. 7A and 8A), and the wall 200 is arranged to travel back and forth between the front and rear faces of the condenser 30 (see FIGS. 7B, 8B). Between the upper and intermediate platform 51 and the lower intermediate platform 52 is disposed the control member 90 for pivotably mounting the evaporator 10 and the condenser 30 and for guiding the movement of the walls 100, 200. The control member 90 carries a fan motor 44 for rotating cross-fans 40, 41 which forcibly move outdoor and indoor air. On the upper surface of the upper intermediate platform 51 and on the lower surface of the lower intermediate platform 52, rails 53 are formed for guiding the travel of the walls 100, 200, respectively. The configuration of the rail 53 comprises a straight line segment SL adjacent a front edge of the upper and lower intermediate platforms 1, 52 and a curved line segment CL extending from the end of the straight line as illustrated in FIG. 3. The curved line runs toward a rear edge of the upper and lower intermediate platforms 51, 52 and turns toward a starting point of the straight line as illustrated in FIG. 3. Further, in the upper surface of the upper intermediate platform 51 and in the lower surface of the lower intermediate platform 52 grooves 54 are formed for guiding the travel of roller bearings 11 which are engaged in the upper and lower end edges 10A, 10B of the evaporator and at similar position in the condenser 30, not shown. At the lower surface of the upper platform 70 and the upper surface of the lower platform 80 a rail 53 and a groove 54 are formed, respectively, having the same configuration as described above.

Further, as illustrated in FIG. 6, at the upper surface of the upper intermediate platform 51 is formed an upper drain duct 55 between the rail 53 and the groove 54 for gathering the condensate from the evaporator 10. The upper drain duct 55 has an upper drain passage 56 which is disposed at a lower level of the drain duct 55. At the upper surface of the lower intermediate platform 52 under the upper drain duct 55 is formed a lower drain duct 57 for collecting the condensate therefrom. At the lowest level of the lower duct 57 a plurality of openings 58 is formed for directing the condensate down to the condenser 30.

Figure 4:
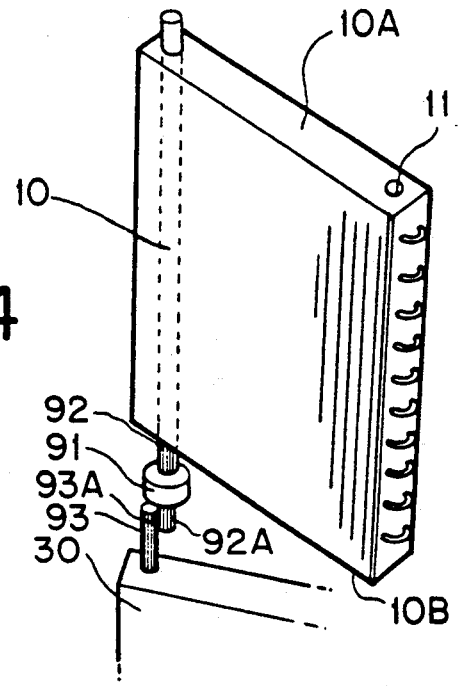
FIG. 4 is a perspective view of a swinging heat exchanger according to the present invention.
Figure 5:
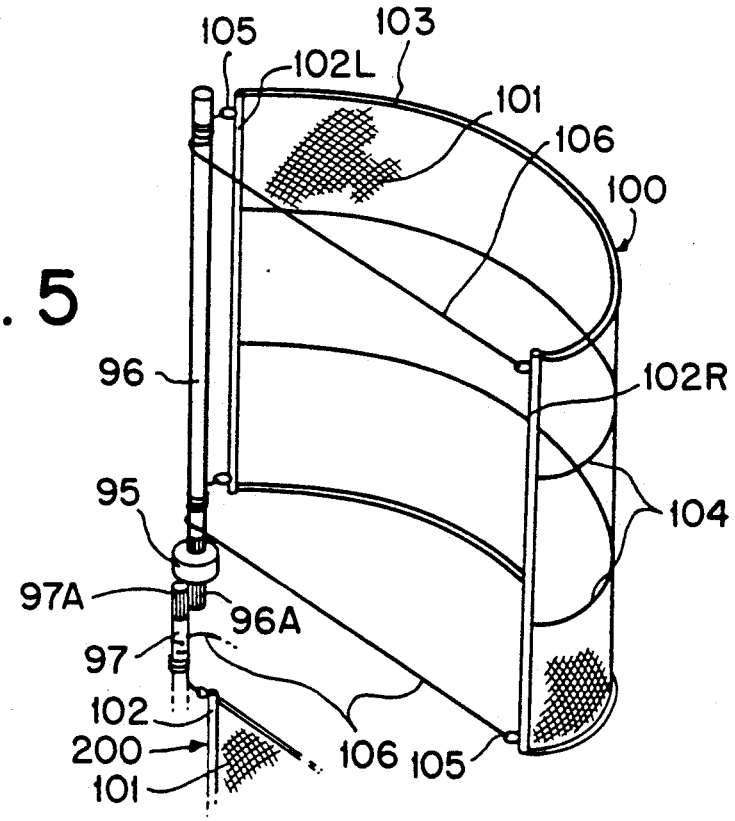
FIG. 5 is a perspective view of a screen member connected to a traveling member according to the present invention.

Engaged at the upper surface of the upper platform 70 and the lower surface of the lower platform 80 are supporting members 42, 43, respectively, for supporting the cross fans 40, 41. In FIGS. 4 and 5, the control member 90 includes a pivot drive member for pivoting both the evaporator 10 and the condenser 30 within a predetermined range, and a traveling member for pivoting the walls 100, 200 back and forth. The pivot drive member comprises a motor 91 which swings both the evaporator 10 and the condenser 30 within the range of the groove 54. The pivot drive member also comprises an upper pivot shaft 92 vertically secured to the evaporator 10. One end of the upper pivot shaft 92 is mounted to the upper platform 70 and the other end thereof is mechanically coupled to the motor 91 and carries a driving gear 92A. The pivot drive member also consists of a lower pivot shaft 93 vertically secured to the condenser 30. One end of the lower pivot shaft 93 is mounted to the lower platform 80 and the other end thereof carries a driven gear 93A which is mechanically coupled to the driving gear 92A of the upper pivot shaft 92. The evaporator 10 and the condenser 30 are positioned in a manner so as to pivot in opposite directions relative to each other. The traveling member comprises a motor 95 which moves walls 100, 200 between the surfaces of the evaporator 10 and those of the condenser 30 back and forth. The motor 95 is disposed near the motor 91 of the pivot drive member. The traveling member also consists of an upper traveling shaft 96 connected to the upper wall 100. One end of the upper traveling shaft 96 is pivotally mounted to the upper platform 70 and the other end thereof is mechanically coupled to the motor 95 and extends further downwardly through the motor 95 and carries a driving gear 96A. The traveling member also consists of a lower traveling shaft 97 connected to the lower wall 200. One end of the lower traveling shaft 97 is pivotally mounted to the lower platform 80 and the other end thereof extends upwardly and carries a driven gear 97A so as to be mechanically coupled to the driving gear 96A. The upper traveling shaft 96 and the lower traveling shaft 97 rotate in opposite directions. When the upper wall is disposed adjacent to the front surface of the evaporator 10, the lower wall is 15 disposed adjacent to the rear surface of the condenser 30 (see FIGS. 8A and 8B). When the upper wall is disposed adjacent to the rear surface of the evaporator 10, the lower wall is disposed adjacent to the front surface of the condenser 30 (see FIGS. 7A and 7B).

The upper and lower walls 100, 200 each consist of a wall element 101 which has a characteristic of heat insulation. A pair of vertical rods 102L, 102R are fixed respectively to both vertical ends of the wall element 101. A pair of horizontal flexible rods 103 are encompassed respectively through each upper and lower horizontal ends of the wall element 101 to permit the wall element 101 to travel along the rail 53. The horizontal rod 103 is elastic for helping the wall 100 to travel to the front or back position. A plurality of supporting rods 104 are disposed in the wall element 101 for reinforcing the wall element 101. Each of the vertical rods 102 has rings 105 at the upper and the lower portion thereof, respectively. One end of a string 106 is tied to the ring 105 at the upper portion of the vertical rod 102L, and the other end of the string 106 is tied to a ring 105 at a corresponding portion of the vertical rod 102R as illustrated in FIG. 5. At the lower portion of the vertical rods 102L, 102R, another string is tied as described above. The strings are wound adjacent to the rear surface of the evaporator 10 up on the upper traveling shaft 96 so that when the left side vertical rod 102L of the wall 100 approaches the traveling shaft 96, the right side vertical rod 102R is retracted away from the traveling shaft 96, and vice versa. A string 106 is wound upon the lower traveling shaft 97 in the reverse manner with respect to the traveling direction of the upper vertical rod 102. That is, when the upper wall 100 is placed adjacent to the rear surface of the evaporator 10 (see FIG. 7A), the lower wall 200 is placed adjacent to the front surface of the condenser 30 (see FIG. 7B). When the upper wall 100 is placed adjacent to the front surface of the evaporator 10 (see FIG. 8A), the lower wall 200 is placed adjacent to the rear surface of the condenser 30 (see FIG. 8B).

Figure 7A:
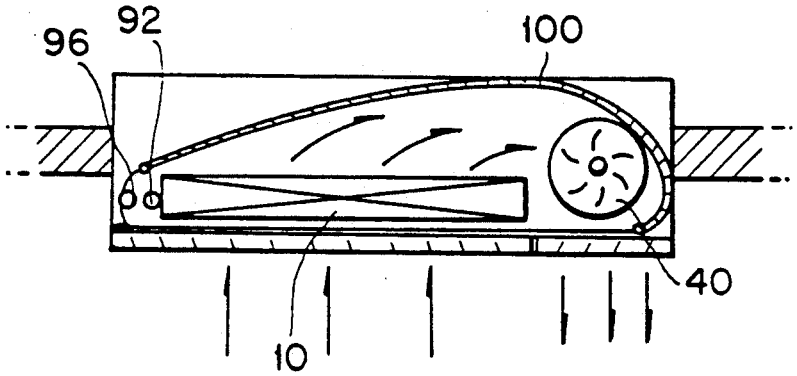
FIG. 7A is a horizontal sectional view of the evaporator compartment in a cooling condition according to the present invention.
Figure 7B:
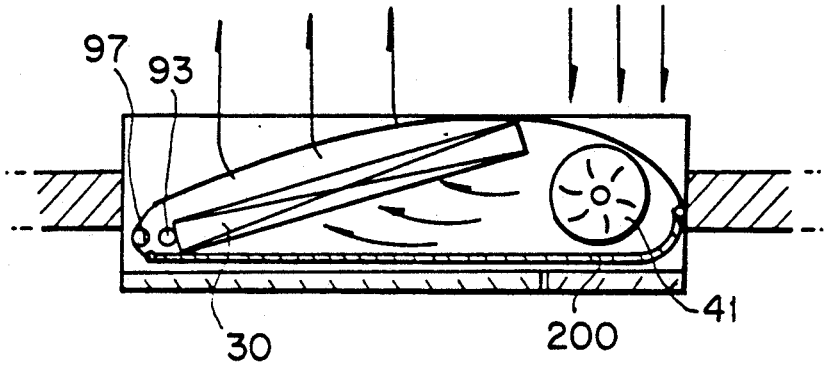
FIG. 7B is a horizontal sectional view of the condenser compartment in a cooling condition according to the present invention.
Figure 9A:
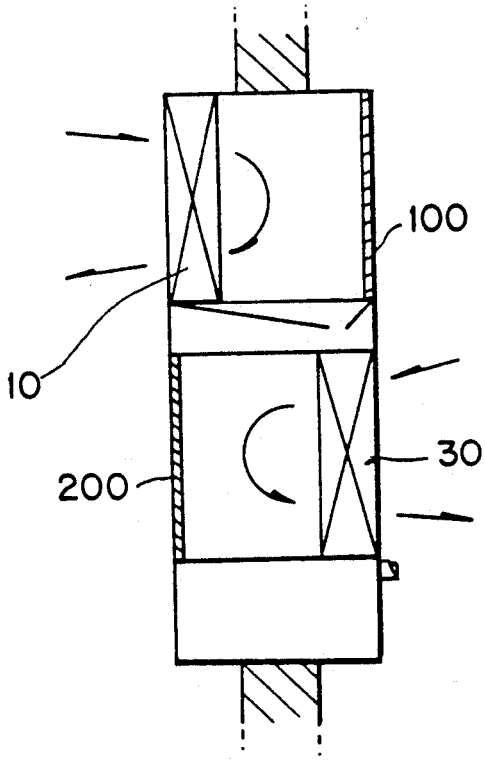
FIG. 9A is a vertical sectional view of an air conditioner in a cooling condition according to the present invention.

In FIGS. 7A, 7B and 9A, the cooling operation is illustrated. The evaporator 10 is disposed adjacent to the indoor area as shown in FIG. 7A. The upper wall 100 is disposed adjacent to the outdoors. The indoor air is taken into the air conditioner through the front grill by the rotation of the cross fan 40. The intake air exchanges heat with the evaporator 10. The flow of the air is guided by the wall 100 and is discharged back to the indoor through the cross fan 40.

In FIG. 7B, the condenser 30 is disposed adjacent to the outdoors. The lower wall 200 is disposed adjacent to the indoors. The outdoor air is taken into the air conditioner through the back grill by the rotation of the cross fan 41 and exchanges heat with the condenser 30. The flow of the air is guided by the wall 200 and is discharged back to the outdoors through the cross fan 41. Therefore, the air in the indoors becomes cool. Furthermore, the condensate generated from the surface of the evaporator 10 drops down to the condenser 30 through the openings 58 formed in the lower intermediate platform 52. The condensate increases the heat loss from the condenser 30 so as to increase the efficiency of the air conditioner.

Figure 8A:
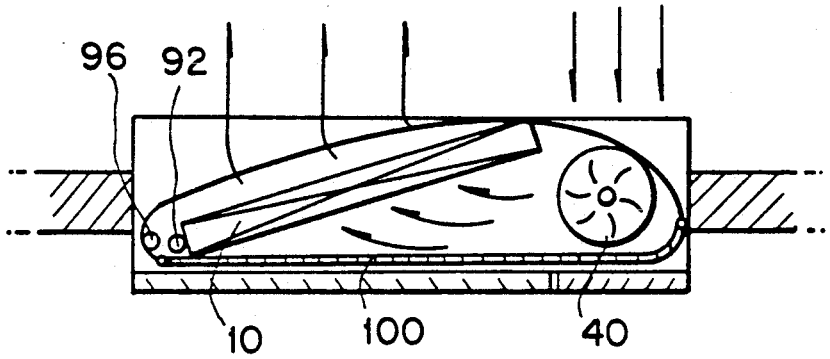
FIG. 8A is a horizontal sectional view of the evaporator compartment in a heating condition according to the present invention.
Figure 8B:
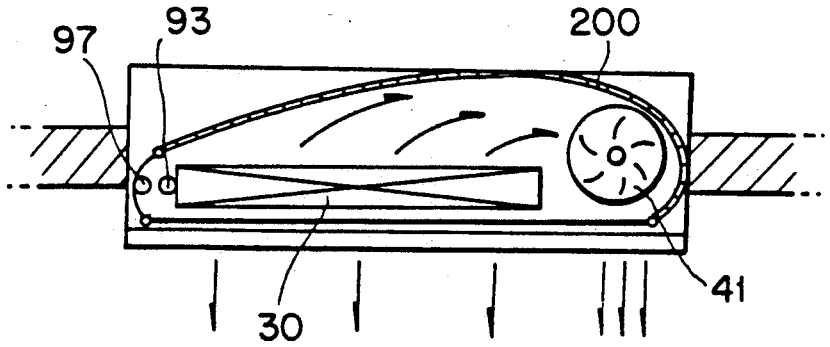
FIG. 8B is a horizontal sectional view of the condenser compartment in a heating condition according to the present invention.
Figure 9B:
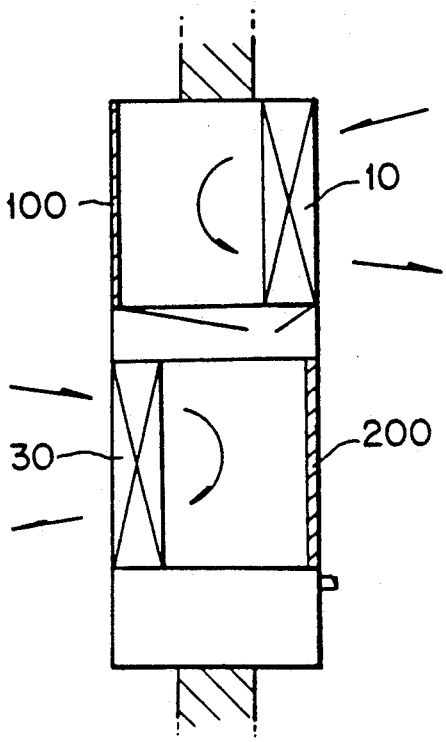
FIG. 9B is a vertical sectional view of an air conditioner in a heating condition according to the present invention.

In FIGS. 8A, 8B and 9B, the heating operation is illustrated.

In FIG. 8A, the evaporator 10 has been moved adjacent to the outdoors along the groove 54 about the upper pivot shaft 92 in a counterclockwise direction. The upper wall 100 has been moved along the rail 53 in a clockwise direction by a clockwise rotation of the traveling shaft 96. The upper wall 100 is disposed adjacent to the indoors. The outdoor air is taken into the air conditioner through the back grill by the rotation of the cross fan 40 and exchanges heat with the evaporator 10. The flow of the air is guided by the wall 100 and is discharged back to the outdoors through the cross fan 40. In FIG. 8B, as the result of a counterclockwise rotational direction of the upper pivot shaft 92 and a simultaneous clockwise rotation of the lower pivot shaft 93, the condenser 30 has been moved adjacent to the outdoors along the groove 54 about the lower pivot shaft 93 in a clockwise direction. As a result of clockwise rotation of the upper traveling shaft 96 and a simultaneous counterclockwise rotation of the lower traveling shaft 97, the lower wall 200 has traveled along the rail 53 in a counterclockwise direction. The lower wall 200 is disposed adjacent to the outdoors. The indoor air is taken into the air conditioner through the grill by the rotation of the cross fan 41 and exchanges heat with the condenser 30. The flow of the air is guided by the wall 200 and is discharged back to the indoors through the cross fan 41. Therefore, the indoor air becomes warm.

In the above described air conditioner, the heating and cooling are achieved in one system without reversing the flow of the refrigerant in the system. Further, the condensate of the evaporator is used to increase the efficiency of the cooling mode.

What is claimed:

1. An air conditioner comprising:

an upper heat exchanger section including:

an upper fan for inducting an upper air flow through said upper heat exchanger section, an upper heat exchanger through which the upper air flow travels, and an upper wall shiftable between opposite sides of said upper heat exchanger section so that when said upper wall is disposed adjacent either of said sides, the upper air flow is drawn from and returned to the ambient air located adjacent the opposite side; and a lower heat exchanger section positioned beneath said upper heat exchanger section and including:

a lower fan for inducing a lower air flow through said heat exchanger section, a lower heat exchanger through which the upper air flow travels, and a lower wall shiftable between opposite sides of said lower heat exchanger section so that when said lower wall is disposed adjacent either of said sides of said lower heat exchanger section, the lower heat exchanger section, the lower air flow is drawn from and returned to the ambient air located adjacent the opposite side of said lower heat exchanger section.

2. An air conditioner according to claim 1 including first flow reversing means for causing the direction of said upper air flow through said upper heat exchanger to be reversed, and second flow reversing means for causing the direction of said lower air flow through said lower heat exchanger to be reversed.

3. An air conditioner according to claim 2, wherein said first flow reversing means comprises means mounting said upper heat exchanger for movement relative to said upper fan, and said second flow reversing means comprising means mounting said lower heat exchanger for movement relative to said lower fan.

4. An air conditioner according to claim 1, wherein said upper and lower walls are interconnected for simultaneous movement.

5. An air conditioner according to claim 1, wherein the relative position between said upper heat exchanger and said upper fan, and the relative position between said lower heat exchanger and said lower fan are adjustable so that the upper and lower air flows pass through said upper and lower heat exchanges, respectively, when said upper and lower walls are shifted.

6. An air conditioner according to claim 5, wherein said upper and lower heat exchangers are movable relative to said upper and lower fans, respectively.

7. An air conditioner according to claim 6, wherein said upper and lower heat exchangers are pivotably mounted.

8. An air conditioner according to claim 6 including motor means for moving said upper and lower heat exchangers.

9. An air conditioner according to claim 6, wherein said motor means comprises a motor connected to move both of said upper and lower heat exchangers simultaneously in opposite directions.

10. An air conditioner according to claim 1, wherein each of said upper and lower walls is flexible.

11. An air conditioner according to claim 10 including frame means forming guide rails for guiding said upper and lower walls during their sifting movement.

12. An air conditioner according to claim 1, wherein said upper and lower walls are interconnected for simultaneous movement in opposite directions.

13. An air conditioner according to claim 1, wherein said upper heat exchanger comprises an evaporator, and said lower heat exchanger comprises a condenser, and means provided for collecting condensate from said evaporator and transferring such condensate to said condenser.

14. An air conditioner according to claim 12 including motor means connected to both of said walls for simultaneously shifting said upper and lower walls.

15. An air conditioner according to claim 14 including upper and lower rods rotated in opposite directions by said motor means, an upper string wound around said upper rod and having opposite ends thereof connected to opposite ends of said upper wall, a lower string wound around said lower rod and having opposite ends thereof connected to opposite ends of said lower wall.

16. An air conditioner comprising:

a housing partitioned into upper and lower sections;

an upper fan disposed in said upper section for inducing an upper air flow;

a lower fan disposed in said lower section and connected for common rotation with said upper fan for inducing a lower air flow;

a motor for rotating said upper and lower fans;

an evaporator disposed in said upper section such that said upper air flow passes therethrough, said evaporator being pivotably movable relative to said upper fan for reversing the direction of said upper air flow therethrough;

a condenser disposed in said lower section such that said lower air flow passes therethrough, said evaporator being pivotably movable relative to said lower fan for reversing the direction of said lower air flow therethrough;

means connected to said evaporator and condenser for pivoting said evaporator and condenser simultaneously in opposite directions;

an upper wall impose in said upper section and shiftable back and forth between opposite sides thereof;

a lower wall disposed in said lower section and shiftable back and forth between opposite sides thereof; and means connected to said upper and lower walls for shifting said upper and lower walls simultaneously in opposite direction.

* * * * *